US010618770B1

(12) United States Patent
Vogeler

(10) Patent No.: US 10,618,770 B1
(45) Date of Patent: Apr. 14, 2020

(54) ELECTRIC FENCE WIRE REEL APPARATUS

(71) Applicant: Craig A. Vogeler, North Loup, NE (US)

(72) Inventor: Craig A. Vogeler, North Loup, NE (US)

( * ) Notice: Subject to any disclaimer, the term of this patent is extended or adjusted under 35 U.S.C. 154(b) by 0 days.

(21) Appl. No.: 16/139,713

(22) Filed: Sep. 24, 2018

Related U.S. Application Data

(63) Continuation-in-part of application No. 16/034,615, filed on Jul. 13, 2018.

(51) Int. Cl.

| | |
|---|---|
| ***B65H 75/24*** | (2006.01) |
| ***B65H 75/42*** | (2006.01) |
| ***B65H 75/44*** | (2006.01) |
| *A01K 3/00* | (2006.01) |

(52) U.S. Cl.
CPC ..... *B65H 75/425* (2013.01); *B65H 75/4402* (2013.01); *B65H 75/4468* (2013.01); *B65H 75/4486* (2013.01); *A01K 3/005* (2013.01); *B65H 2402/42* (2013.01); *B65H 2403/92* (2013.01); *B65H 2701/364* (2013.01)

(58) Field of Classification Search
CPC ..... B65H 75/425; B65H 75/4468; B65H 75/4486; B65H 75/4402; B65H 2402/42; B65H 2701/364; A01K 3/005
See application file for complete search history.

(56) References Cited

U.S. PATENT DOCUMENTS

| | | | | |
|---|---|---|---|---|
| 8,702,029 | B1 * | 4/2014 | Thompson | B65H 49/321 242/403 |
| 8,827,198 | B1 * | 9/2014 | Steadman, Sr. | B65H 75/305 242/118.6 |
| 9,874,040 | B1 * | 1/2018 | Smith | E04H 17/266 |
| 2003/0234316 | A1 * | 12/2003 | Sloan | B65H 75/242 242/573.9 |
| 2011/0127481 | A1 * | 6/2011 | Petty | E04H 17/266 256/37 |

* cited by examiner

*Primary Examiner* — Sang K Kim
(74) *Attorney, Agent, or Firm* — Dennis L. Thomte; Thomte Patent Law Office LLC

(57) ABSTRACT

An electric fence wire reel apparatus which is configured to be secured to the hitch receiver of a hitch at the rearward end of a vehicle. The reel may be used as a wire rewind reel powered by an electric drill or an electric motor. The apparatus may be used as a wire rewind reel or a freely rotatably wire reel.

12 Claims, 7 Drawing Sheets

ELECTRIC FENCE WIRE REEL APPARATUS

CROSS REFERENCE TO RELATED APPLICATION

This is a Continuation-In-Part Application of application Ser. No. 16/034,615 filed Jul. 13, 2018, entitled ELECTRIC FENCE WIRE REEL APPARATUS.

BACKGROUND OF THE INVENTION

Field of the Invention

This invention relates to an electric fence wire reel apparatus and more particularly to an electric fence wire reel apparatus which is secured to a hitch receiver at the rearward end of an ATV or the like.

Description of the Related Art

Electric fence wires have long been used to fence areas such as corn stalk fields to maintain the cattle therein for a period of time. The electric fences are frequently moved to other locations. Usually, the fences are moved to another location by first removing the posts which support the electric wire thereon and then winding the fence wire onto a reel or the like. The reels are normally supported on a post during the rewinding of the fence wire. An example of an electric fence wire reel is marketed by Premier 1 Supplies. However, the reel of Premier 1 is mounted on a post and is not designed to be secured to a hitch receiver mounted on an ATV or the like. Further, the reel of Premier 1 can only be operated from one side of the reel due to the design of the reel mounting frame thereof. The electric fence wire reel apparatus of the co-pending application represents an improvement in the art. The instant application represents a further advance in the art.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An electric fence wire reel apparatus is described for attachment to the receiver tube of a hitch mounted at the rearward end of the vehicle. The apparatus includes an elongated and horizontally disposed draw bar having a forward end and a rearward end with the forward end of the draw bar being configured to be secured to the receiver tube of the hitch. The apparatus also includes an elongated and vertically disposed first support member having a lower end and an upper end with the lower end of the first support being secured to the rearward end of the draw bar. A first sleeve is selectively vertically slidably mounted on the first support member with the first sleeve having a forward side, a first side, a rearward side and a second side. An elongated and horizontally disposed second support member having a forward end and a rearward end has its forward end secured to the rearward side of the first sleeve. A horizontally disposed and elongated third support member, having an inner end and a rearward end, has its rearward end operatively secured to the second support and extending laterally from the second support member. The third support member is configured to support a rotational driver apparatus thereon such as an electric drill or an electric motor.

A vertically disposed first bearing is operatively secured to the rearward end of the second support member with the first bearing having a horizontally disposed central opening formed therein. A vertically disposed second bearing is operatively secured to the rearward end of the second support member with the second bearing being laterally spaced inwardly of the first bearing with the second bearing having a horizontally disposed central opening formed therein. The apparatus also includes an elongated and horizontally disposed drive shaft having an outer end and an inner end. The drive shaft is positioned in the central openings of the first and second bearings for rotation with respect to the first and second bearings. The outer end of the drive shaft is positioned outwardly of the first bearing whereby the outer end of the drive shaft may be connected to and rotated by the rotational drive apparatus. A vertically disposed circular disk, having an inner side and an outer side, is positioned on and secured to the drive shaft inwardly of the second bearing for rotation with the drive shaft. The drive shaft is configured to have an electric wire reel mounted thereon inwardly of the circular disk. The circular disk engages the electric wire reel thereon whereby rotation of the drive shaft causes the wire reel to be rotated.

In the preferred embodiment, the inner side of the circular disk has a pin extending therefrom wherein the pin engages the electric wire reel to cause rotation of the electric wire reel. In the preferred embodiment, the first support member is selectively vertically adjustably secured to the rearward end of the draw bar. In the preferred embodiment, the second support member is selectively vertically adjustably secured to the first support member. In the preferred embodiment, the third support member is selectively horizontally adjustably secured to the second support member.

A second embodiment is disclosed wherein a transversely extending and horizontally disposed elongated tube is welded to the rearward end of the second support member. A first brass or bronze bushing is positioned in one end of the elongated tube and a second brass or bronze bushing is positioned in the other end of the elongated tube. The drive shaft rotatably extends through the bushings and the tube.

It is therefore a principal object of the invention to provide an improved electric fence wire reel apparatus.

A further object of the invention is to provide an electric fence wire reel apparatus which may be attached to the receiver tube of a hitch mounted at the rear end of an ATV or the like.

A further object of the invention is to provide an electric fence wire reel apparatus which may rotated by a battery operated electric drill or an electric motor.

A further object of the invention is to provide an electric fence wire reel apparatus which is convenient to use and which is safe to use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 4 is a rear perspective view of the electric fence wire reel apparatus of this invention secured to the rear end of an ATV or the like;

FIG. 5 is a partial side view of the electric fence wire reel apparatus of this invention secured to the rear end of a vehicle such as an ATV or the like;

DESCRIPTION OF THE PREFERRED EMBODIMENT

Figure 1:
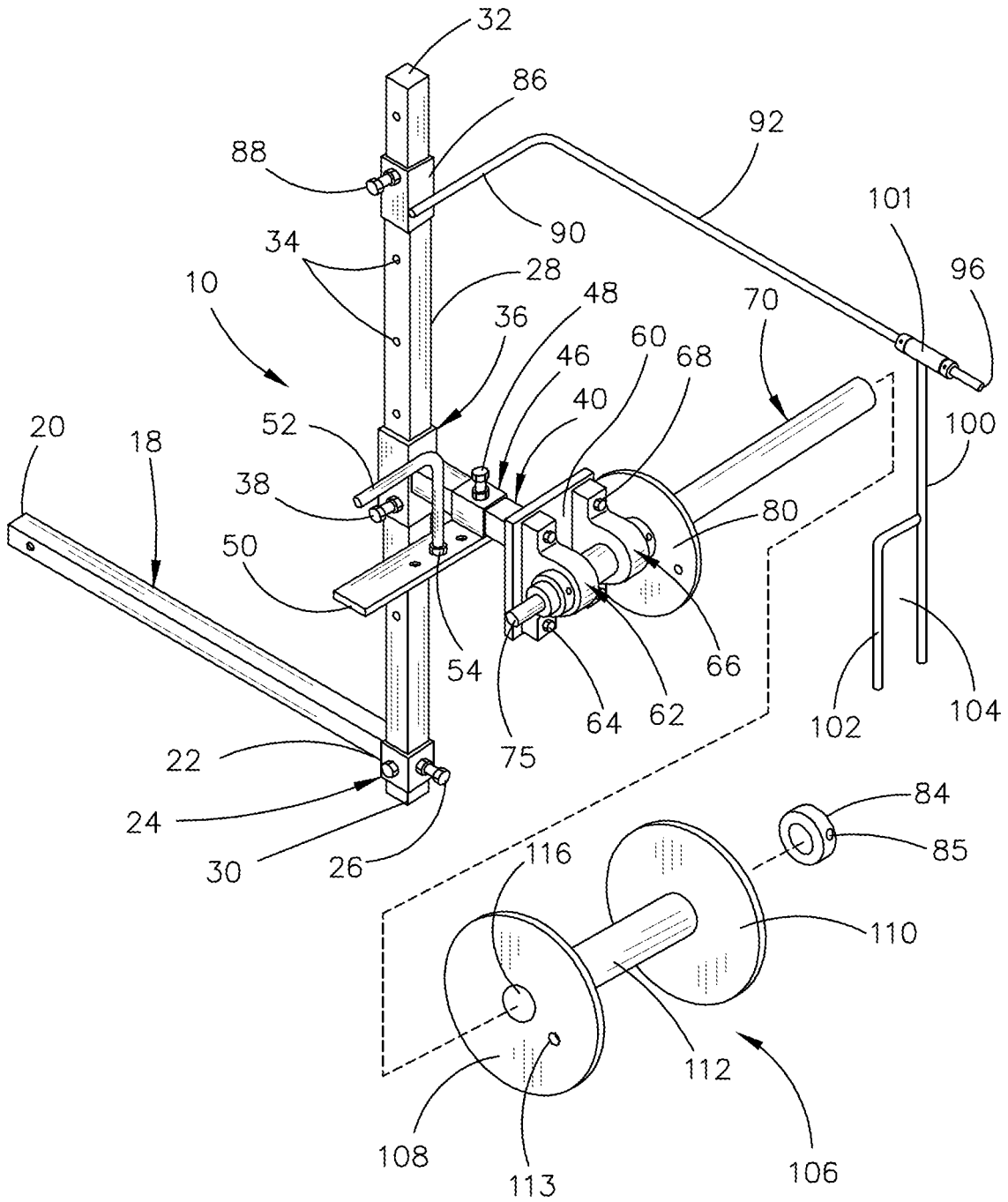
FIG. 1 is a partially exploded perspective view of the electric fence wire reel apparatus of this invention.
Figure 2:
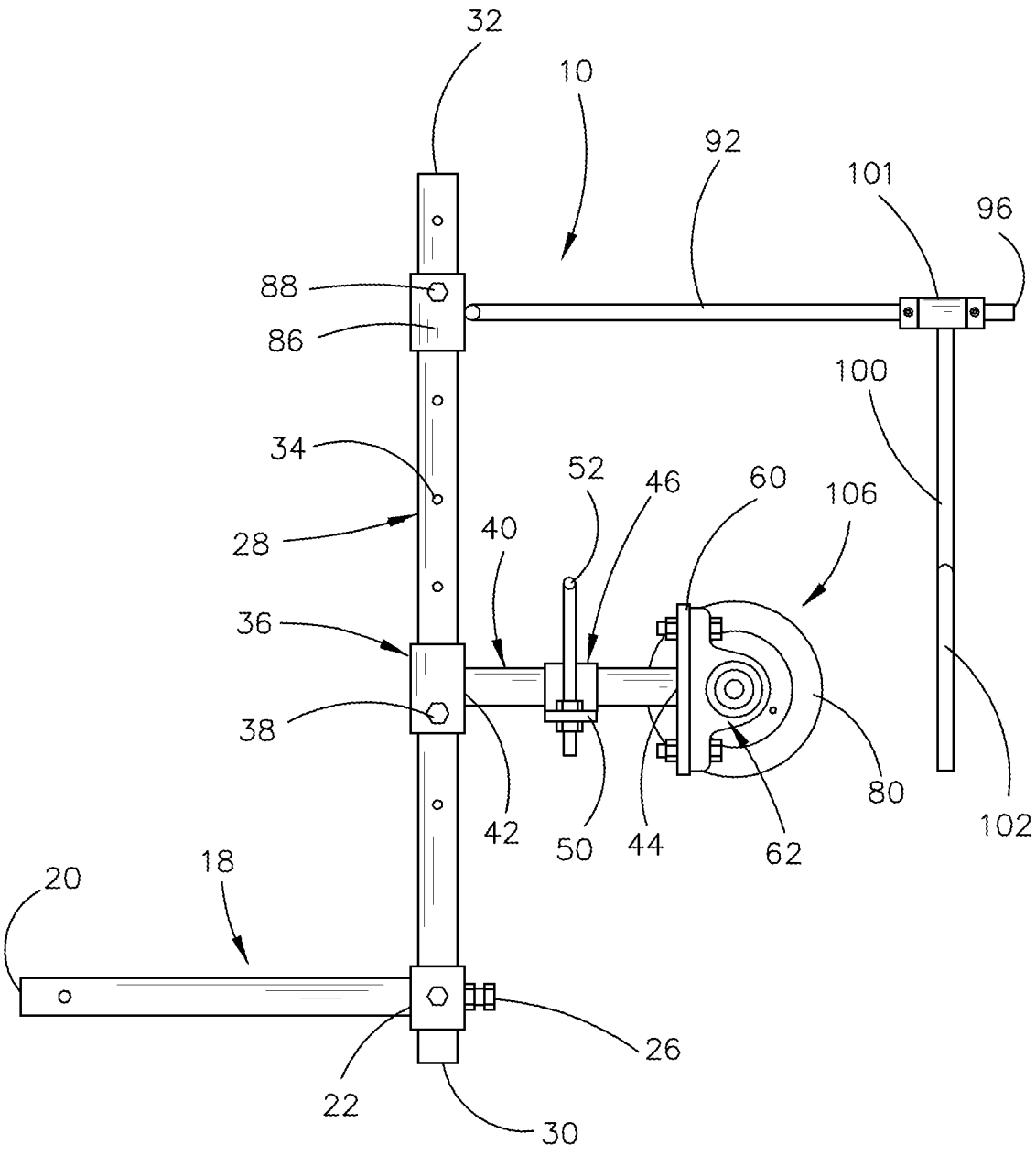
FIG. 2 is a side view of the electric fence wire reel apparatus of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Apparatus 10 is designed to be attached to the receiver tube 12 of a hitch 14 at the rearward end of a vehicle 16 such as an ATV or the like. Apparatus 10 includes a horizontally disposed drawbar 18 having a forward end 20 and a rearward end 22. The forward end 20 of drawbar 18 is configured to be received in receiver tube 12 of hitch 14 and maintained therein by bolt or pin 23. A square tube 24 is welded to the rearward end 22 of drawbar 18. Tube 24 includes at least one set screw 26 or bolt extending thereinto or therethrough. The numeral 28 refers to a vertically disposed support member having a lower end 30 and an upper end 32. The lower end 30 of support member 28 is vertically adjustably received in tube 24 and maintained therein by the set screw or bolt 26. Support member 28 has a plurality of vertically spaced-apart bolt openings 34 formed therein which extend inwardly through the side thereof. A bolt 35 extends through tube 24 and support member 28.

A square tubular sleeve or collar 36 is selectively vertically adjustably mounted on support member 28 and is maintained thereon by a set screw or bolt 38. The numeral 40 refers to a horizontally disposed and elongated tubular member or support member having a forward end 42 and a rearward end 44. The forward end 42 of tubular member 40 is welded to the rearward side of sleeve 36. A square tube 46 longitudinally adjustably embraces tubular member 44 and is held in place by a set screw or bolt 48. A horizontally disposed plate 50 has its inner end welded to the underside of tube 46 and extends laterally outwardly therefrom. An inverted L-shaped rod 52 has its lower end 54 longitudinally adjustably bolted to the plate 50 and extends upwardly from plate 50 and then laterally outwardly. Rod 52 includes rod portions 56 and 58.

Figure 3:
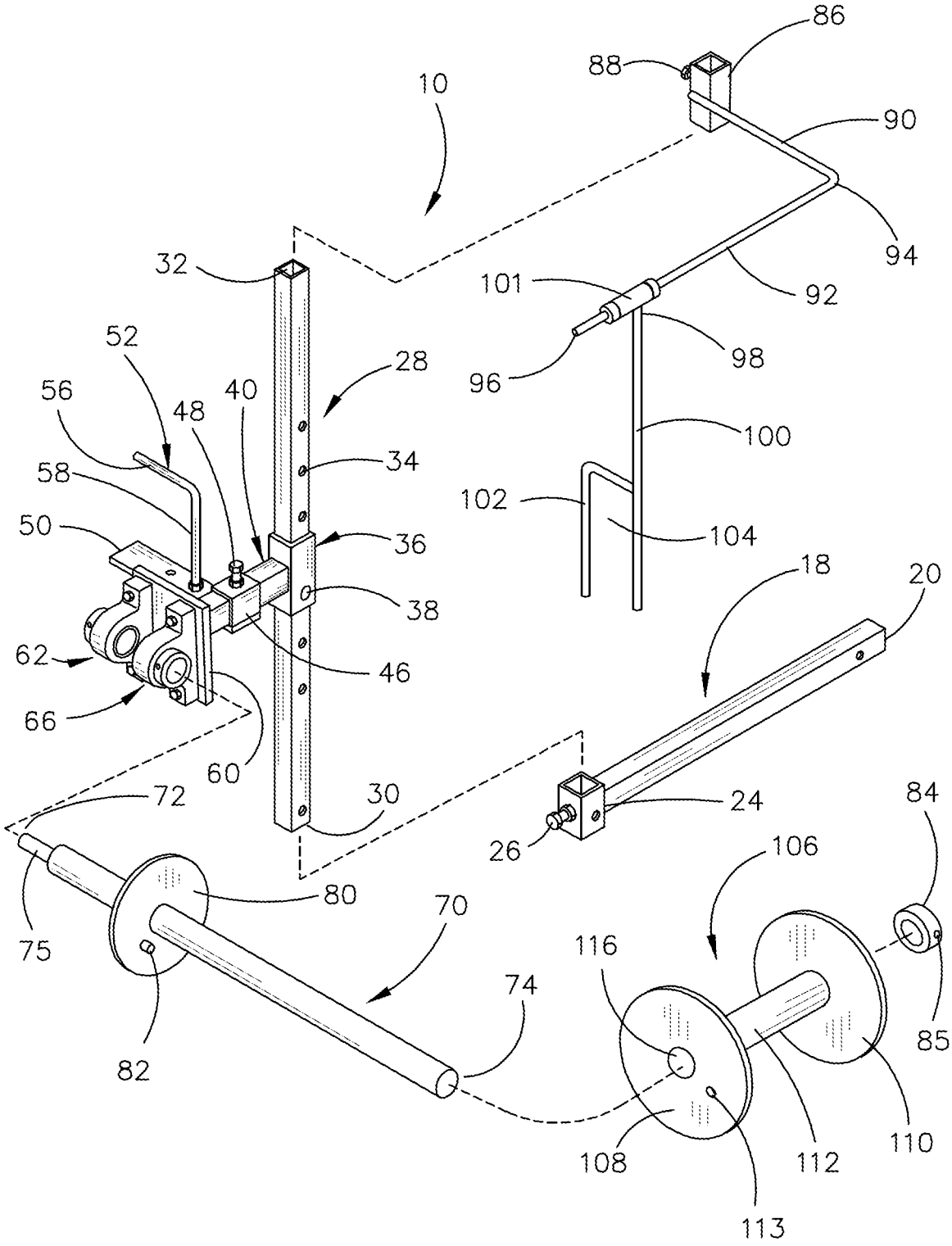
FIG. 3 is an exploded perspective view of the electric fence wire reel apparatus of this invention.
Figure 4:
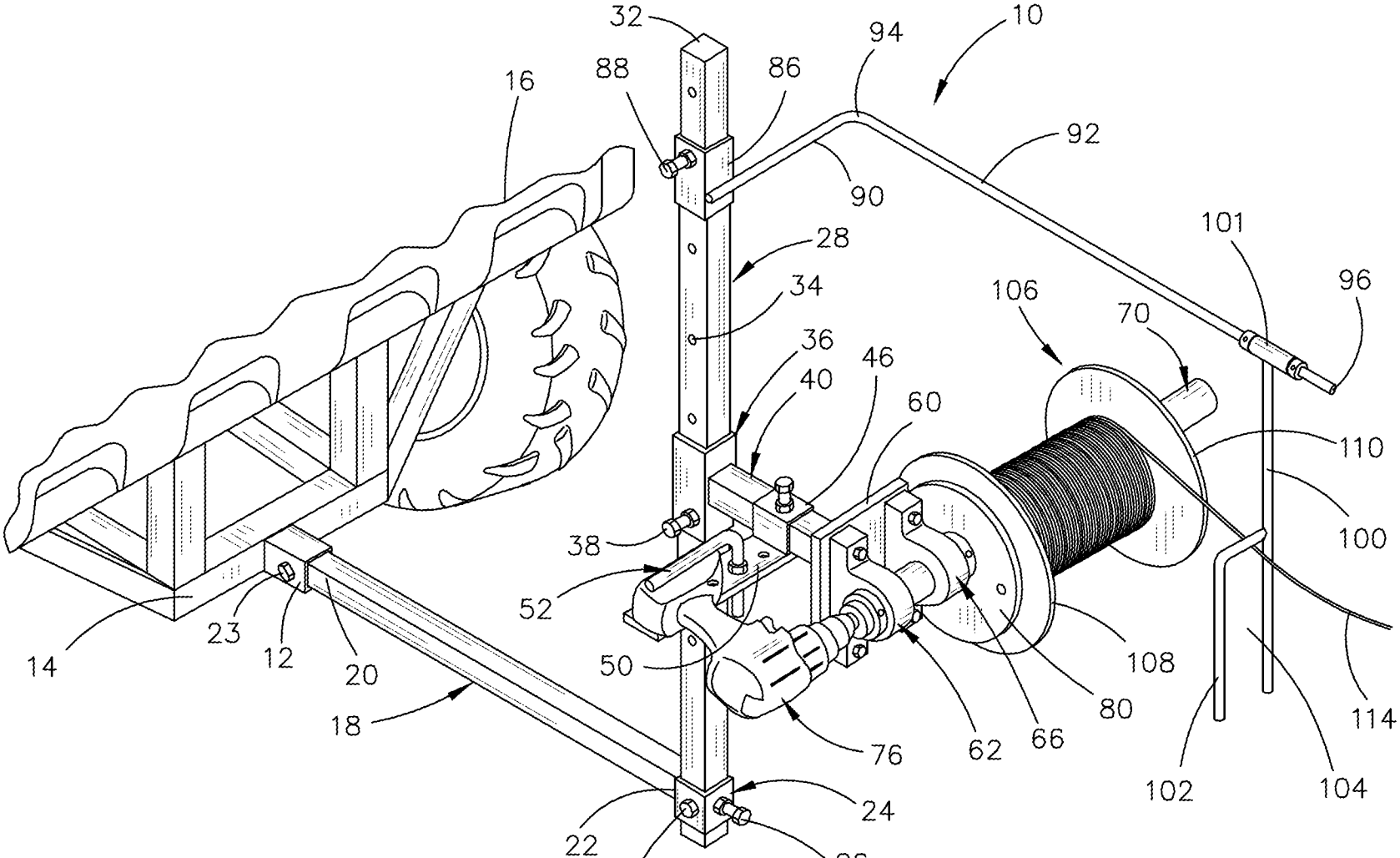
Figure 5:
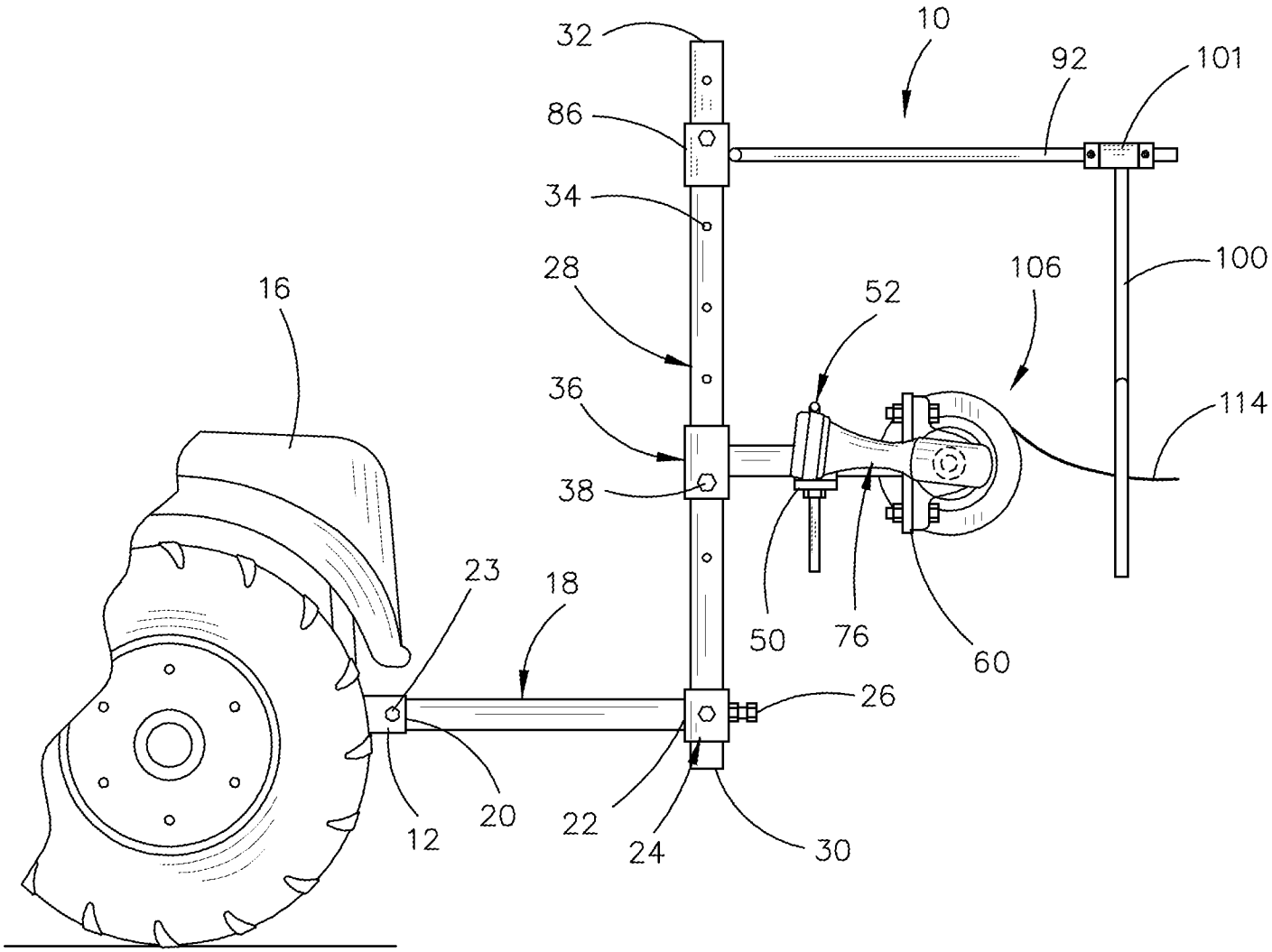
Figure 6:
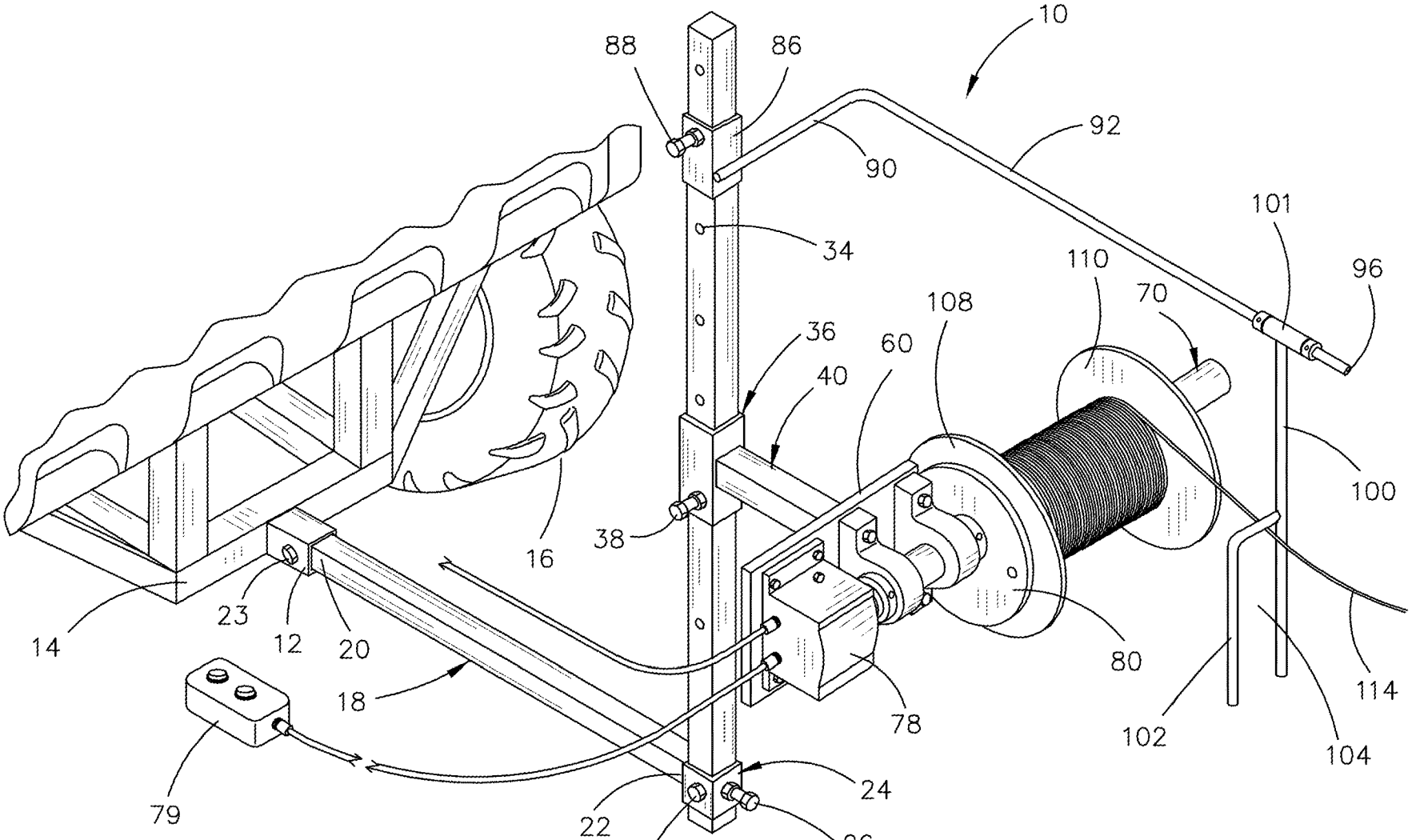
FIG. 6 is a rear perspective view of the electric fence wire reel apparatus of this invention having a reel mounted on the drive shaft thereof.

A vertically disposed plate 60 is welded or otherwise secured to the outer end of tubular member 40. An outer bearing 62 is secured to plate 60 by bolts 64. An inner bearing 66 is secured to plate 60 by bolts 68. As seen, bearings 62 and 66 are horizontally spaced-apart. Bearings 62 and 66 include central bores or openings formed therein as seen in FIG. 3. The numeral 70 refers to an elongated and horizontally disposed drive shaft having an inner end 72 and an outer end 74. The inner end 72 of shaft 70 has a reduced diameter portion 75 so that an electric drill 76 or motor 78 may be attached thereto. The electric drill 76 is supported on the plate 50 and held in position by the rod 52. Shaft 70 rotatably extends through bearings 62 and 66 which maintain the shaft 70 in a horizontally disposed position. The electric motor 78 is connected to the electrical system of the vehicle 16 and controlled by switch 79.

A circular disk or plate 80 embraces shaft 70 and is welded thereto laterally inwardly of bearing 66. Plate 80 has an ear, pin or stud 82 which extends from the inner side thereof which is offset from the center of the disk 80. As will be explained hereinafter, a locking collar 84 selectively adjustably embraces shaft 70 and is held in position by a set screw 85.

A square tube 86 is selectively vertically adjustably mounted on the upper end of support member 28 and is held in place by a bolt or set screw 88. A horizontally disposed rod member 90 has its inner end secured to tube 86 and extends horizontally laterally therefrom. A rod member 92 has its inner end 94 secured to the outer end of rod member 90 and extends horizontally rearwardly therefrom. The rearward end 96 of rod member 92 has the upper end 98 of a vertically disposed rod member 100 rotatably secured thereto by a rotational connector 101. An inverted L-shaped rod 102 has its upper end welded to rod member 100 to define a wire receiving opening 104 therebetween.

The numeral 106 refers to a rewind wire reel which includes plates 108 and 110 secured to the ends of a hollow hub 112. Plate 108 has an opening 113 formed therein which is offset from the center of the plate 108. The numeral 114 refers to an electric fence wire wound upon reel 106 and which extends through opening 104 as will be explained hereinafter. Plate 108 has an opening 116 formed therein which registers with the hollow hub 112. Plate 110 has a similar opening which registers with the hollow hub 112.

Initially, the reel 106 will not be mounted on the shaft 70. Upon the purchase of an electric fence reel having an electrical fence wire 114 wound thereon wherein it is desired to place the purchased electric fence wire onto the ground for subsequent attachment to fence posts, the purchased reel will be rotatably mounted on the shaft 70 wherein the shaft 70 extends through the center of the purchased wire reel. Almost any size of the purchased reel may be accommodated by the apparatus. A locking collar 84 will be secured to shaft 70 inwardly of the purchased wire reel and a locking collar 84 will be secured to shaft 70 outwardly of the purchased reel with the collars 84 maintaining the purchased reel in position. The free end of the fence wire of the purchased reel will be anchored to the ground or to a fence post. The vehicle 16 will then be driven on the line where the electric fence is to be installed. The wire on the purchased reel will be unwound and be positioned on the ground. The fence wire will then be secured to upstanding fence posts.

When it is desired to move the electric fence wire from one location to another, the empty reel will be removed from the shaft 70. The rewind reel 106 will then be mounted on the shaft 70 so that the plate 108 is positioned adjacent plate 80 so that stud 82 is received in opening 113 of plate 108. A locking collar 84 will then be positioned on shaft 70 and secured thereto at the outer side of plate 110.

The drill 76 or motor 78 will then be actuated to rewind the wire 114 onto the reel 106. The wire 114 passes through the opening 104 as the wire 114 is wound upon reel 106. The person rewinding the wire 114 onto the reel 106 will manually pivotally move rod member 100 laterally so that the wire 114 will be wound evenly on reel 106.

Figure 7:
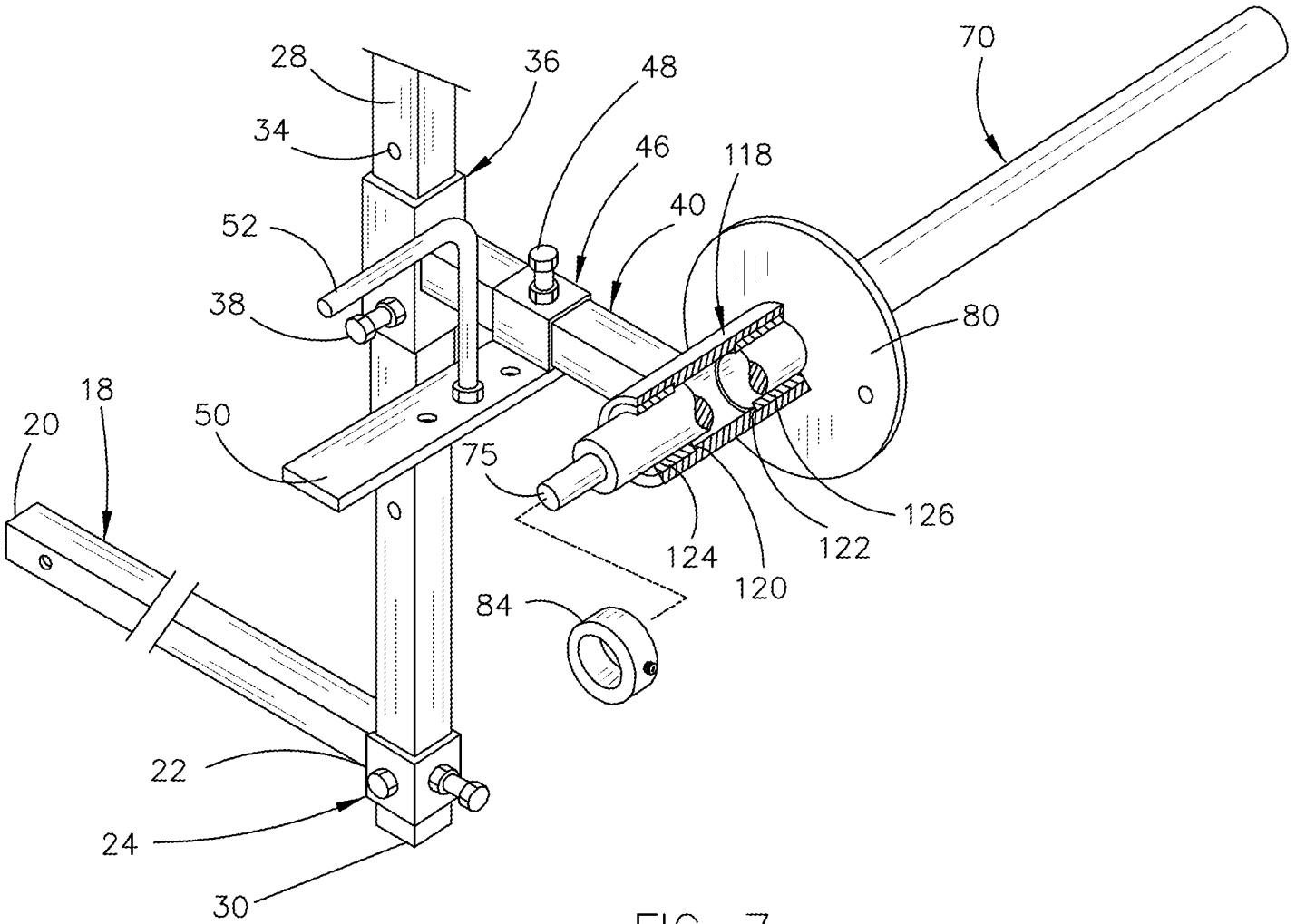
FIG. 7 is a partial rear perspective view of a second embodiment of the invention.

FIG. 7 illustrates a modification of the invention which is designed to replace the outer bearing 62 and the inner bearing 66. As seen in FIG. 7, a horizontally disposed and transversely extending hollow metal tube 118 is welded to the outer end of support member 40. The interior of tube 118 has annular shoulders 120 and 122 formed therein. A bronze or brass bushing 124 is positioned in the outer end of tube 118 and a bronze or brass bushing 126 is positioned in the inner end of tube 118. The shoulders 120 and 122 limit the inward movement of bushings 124 and 126 in tube 118.

The drive shaft 70 rotatably extends through bushings 124 and 126. A locking collar 84 is secured to shaft 70 outwardly of tube 118. The plate 80 on shaft 70 is positioned at the inner end of tube 118. The bushings 124 and 126 perform the same functions as the bearings 62 and 66 but are somewhat less expensive than the bearings 62 and 66.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An electric fence wire reel apparatus for attachment to a receiver tube of a hitch mounted at the rearward end of a vehicle, comprising:

an elongated and horizontally disposed draw bar having a forward end and a rearward end;

said forward end of said draw bar configured to be secured to the receiver tube of the hitch;

an elongated and vertically disposed first support member having a lower end and an upper end;

said lower end of said first support being secured to said rearward end of said draw bar;

a first sleeve mounted on said first support member;

said first sleeve having a forward side, a first side, a rearward side and a second side;

an elongated and horizontally disposed second support member having a forward end and a rearward end;

said forward end of said second support member being secured to rearward side of said first sleeve;

a horizontally disposed and elongated third support member having an inner end and a rearward end;

said inner end of said third support member being operatively secured to said second support and extending laterally from said second support member;

said third support member being configured to support a rotational drive apparatus thereon;

a vertically disposed first bearing operatively secured to said rearward end of said second support member;

said first bearing having a horizontally disposed central opening formed therein;

a vertically disposed second bearing operatively secured to said rearward end of said second support member;

said second bearing being laterally spaced inwardly of said first bearing;

said second bearing having a horizontally disposed central opening formed therein;

an elongated and horizontally disposed drive shaft having an outer end and an inner end;

said drive shaft being positioned in said central openings of said first and second bearings for rotation with respect to said first and second bearings;

said inner end of said drive shaft being positioned outwardly of said first bearing whereby said inner end of said drive shaft may be connected to and rotated by said rotational drive apparatus;

a vertically disposed circular disk having an inner side and an outer side;

said circular disk being positioned on and secured to said drive shaft inwardly of said second bearing for rotation with said drive shaft;

said drive shaft being configured to have an electric rewind wire reel mounted thereon outwardly of said circular disk for winding an electric fence wire thereon; and said circular disk engaging the electric rewind wire reel whereby rotation of said drive shaft causes said electric rewind wire reel to be rotated to wind the electric fence wire thereon.

2. The electric fence wire reel apparatus of claim 1 wherein said inner side of said circular disk has a pin extending therefrom and wherein said pin engages the electric wire reel to cause rotation of said electric wire reel when said circular disk is rotated.

3. The electric fence wire reel apparatus of claim 1 wherein said first support member is selectively vertically adjustably secured to said rearward end of said draw bar.

4. The electric fence wire reel apparatus of claim 1 wherein said second support member is selectively vertically adjustably secured to said first support member.

5. The electric fence wire reel apparatus of claim 1 wherein said third support member is selectively horizontally adjustably secured to said second support member.

6. The electric fence wire reel apparatus of claim 1 including means for laterally moving the electric fence wire with respect to said electric rewind wire reel as the electric fence wire is wound on the rewind reel.

7. An electric fence wire reel apparatus for attachment to a receiver tube of a hitch mounted at the rearward end of a vehicle, comprising:

an elongated and horizontally disposed draw bar having a forward end and a rearward end;

said forward end of said draw bar configured to be secured to the receiver tube of the hitch;

an elongated and vertically disposed first support member having a lower end and an upper end;

said lower end of said first support being secured to said rearward end of said draw bar;

a first sleeve mounted on said first support member;

said first sleeve having a forward side, a first side, a rearward side and a second side;

an elongated and horizontally disposed second support member having a forward end and a rearward end;

said forward end of said second support member being secured to rearward side of said first sleeve;

a horizontally disposed and elongated third support member having an inner end and a rearward end;

said inner end of said third support member being operatively secured to said second support and extending laterally from said second support member;

said third support member being configured to support a rotational driver apparatus thereon;

a vertically disposed first bearing operatively secured to said rearward end of said second support member;

said first bearing having a horizontally disposed central opening formed therein;

a vertically disposed second bearing operatively secured to said rearward end of said second support member;

said second bearing being laterally spaced inwardly of said first bearing;

said second bearing having a horizontally disposed central opening formed therein;

an elongated and horizontally disposed drive shaft having an outer end and an inner end;

said inner end of said drive shaft being positioned in said central openings of said first and second bearings for rotation with respect to said first and second bearings;

said inner end of said drive shaft being positioned outwardly of said first bearing whereby said inner end of said drive shaft may be connected to and rotated by said rotational drive apparatus;

an electric fence wire reel, having an electric fence wire wrapped therearound; and said electric fence wire reel being freely rotatably mounted on said drive shaft whereby the wire of said electric fence wire reel may be freely unwound therefrom.

8. An electric fence wire reel apparatus for attachment to a receiver tube of a hitch mounted at the rearward end of a vehicle, comprising:

an elongated and horizontally disposed draw bar having a forward end and a rearward end;

said forward end of said draw bar configured to be secured to the receiver tube of the hitch;

an elongated and vertically disposed first support member having a lower end and an upper end;

said lower end of said first support being secured to said rearward end of said draw bar;

a first sleeve mounted on said first support member;

said first sleeve having a forward side, a first side, a rearward side and a second side;

an elongated and horizontally disposed second support member having a forward end and a rearward end;

said forward end of said second support member being secured to rearward side of said first sleeve;

a horizontally disposed and elongated third support member having an inner end and a rearward end;

said inner end of said third support member being operatively secured to said second support and extending laterally from said second support member;

said third support member being configured to support a rotational driver apparatus thereon;

a vertically disposed first bearing operatively secured to said rearward end of said second support member;

said first bearing having a horizontally disposed central opening formed therein;

a vertically disposed second bearing operatively secured to said rearward end of said second support member;

said second bearing being laterally spaced inwardly of said first bearing;

said second bearing having a horizontally disposed central opening formed therein;

an elongated and horizontally disposed drive shaft having an outer end and an inner end;

said inner end of said drive shaft being positioned in said central openings of said first and second bearings for rotation with respect to said first and second bearings;

said inner end of said drive shaft being positioned outwardly of said first bearing whereby said inner end of said drive shaft may be connected to and rotated by said rotational drive apparatus;

said drive shaft being configured to have an electric fence wire reel apparatus mounted thereon outwardly of said inner drive shaft support for rotation by said rotational drive apparatus; and said drive shaft also being configured to have an electric fence wire reel apparatus freely rotatably mounted thereon.

9. An electric fence wire reel apparatus for attachment to a receiver tube of a hitch mounted at the rearward end of a vehicle, comprising:

an elongated and horizontally disposed draw bar having a forward end and a rearward end;

said forward end of said draw bar configured to be secured to the receiver tube of the hitch;

an elongated and vertically disposed first support member having a lower end and an upper end;

said lower end of said first support being secured to said rearward end of said draw bar;

a first sleeve mounted on said first support member;

said first sleeve having a forward side, a first side, a rearward side and a second side;

an elongated and horizontally disposed second support member having a forward end and a rearward end;

said forward end of said second support member being secured to rearward side of said first sleeve;

a horizontally disposed and elongated third support member having an inner end and a rearward end;

said inner end of said third support member being operatively secured to said second support and extending laterally from said second support member;

said third support member being configured to support a rotational driver apparatus thereon;

an elongated and horizontally disposed tube, having first and second ends, secured to said rearward end of said second support member and extending transversely with respect thereto;

a first bushing positioned in first end of said tube;

a second bushing positioned in said second end of said tube;

an elongated and horizontally disposed drive shaft having an outer end and an inner end;

said inner end of said drive shaft being positioned in said first and second bushings for rotation with respect to said first and second bushings;

said inner end of said drive shaft being positioned outwardly of said first bushing whereby said inner end of said drive shaft may be connected to and rotated by said rotational drive apparatus;

said drive shaft being configured to have an electric fence wire reel apparatus mounted thereon outwardly of said inner drive shaft support for rotation by said rotational drive apparatus; and said drive shaft also being configured to have an electric fence wire reel apparatus freely rotatably mounted thereon.

10. An electric fence wire reel apparatus for attachment to a receiver tube of a hitch mounted at the rearward end of a vehicle, comprising:

an elongated and horizontally disposed draw bar having a forward end and a rearward end;

said forward end of said draw bar configured to be secured to the receiver tube of the hitch;

an elongated and vertically disposed first support member having a lower end and an upper end;

said lower end of said first support being secured to said rearward end of said draw bar;

an elongated and horizontally disposed second support member having a forward end and a rearward end;

said forward end of said second support member being secured to said first support member;

a horizontally disposed and elongated third support member having an inner end and a rearward end;

said inner end of said third support member being operatively secured to said second support and extending laterally from said second support member;

said third support member being configured to support a rotational driver apparatus thereon;

an outer drive shaft support operatively secured to said outer end of said second support member;

an inner drive shaft support operatively secured to said outer end of said second support member;

said outer and inner drive shaft supports being horizontally spaced apart;

an elongated and horizontally disposed drive shaft having an outer end and an inner end;

said drive shaft being rotatably mounted in said first and second drive shaft supports;

said inner end of said drive shaft being positioned outwardly of said outer drive shaft support whereby said inner end of said drive shaft may be connected to and rotated by said rotational drive apparatus;

said drive shaft being configured to have an electric fence wire reel apparatus mounted thereon outwardly of said outer drive shaft support for rotation by said rotational drive apparatus; and said drive shaft also being configured to have an electric fence wire reel apparatus freely rotatably mounted thereon.

11. The apparatus of claim 10 wherein each of said outer and inner drive shaft supports are bearings.

12. The apparatus of claim 10 wherein each of said outer and inner drive shaft supports includes bushings through which said drive shaft extends.

* * * * *